US009303353B2

(12) United States Patent
Audet et al.

(10) Patent No.: US 9,303,353 B2
(45) Date of Patent: Apr. 5, 2016

(54) BASKET

(71) Applicant: United Comb & Novelty Corporation, Leominster, MA (US)

(72) Inventors: Ronald Audet, North Smithfield, RI (US); Rebecca Foster, West Lebanon, NH (US); Theresa Savoia Scalzi, Concord, MA (US)

(73) Assignee: United Comb + Novelty Corporation, Leominster, MA (US)

( * ) Notice: Subject to any disclaimer, the term of this patent is extended or adjusted under 35 U.S.C. 154(b) by 8 days.

(21) Appl. No.: 14/255,409

(22) Filed: Apr. 17, 2014

(65) Prior Publication Data

US 2014/0367397 A1 Dec. 18, 2014

Related U.S. Application Data

(60) Provisional application No. 61/834,187, filed on Jun. 12, 2013.

(51) Int. Cl.

| | |
|---|---|
| ***B65D 33/06*** | (2006.01) |
| ***A45C 13/26*** | (2006.01) |
| ***A45F 3/00*** | (2006.01) |
| ***D06F 95/00*** | (2006.01) |

(52) U.S. Cl.
CPC ..... *D06F 95/002* (2013.01)

(58) Field of Classification Search
CPC ..... A45C 13/30; A45C 3/04; A45C 13/26; A45C 5/045; A45F 2003/142; A45F 3/14; A45F 3/047; A45F 5/10; A45F 2005/006; A45F 2005/1013; A45F 3/02
USPC ..... 383/13, 14, 15; 150/108; 224/629, 645, 224/579; D03/216
See application file for complete search history.

(56) References Cited

U.S. PATENT DOCUMENTS

| | | | | |
|---|---|---|---|---|
| 5,344,041 | A * | 9/1994 | Luburic et al. | 220/760 |
| 5,984,157 | A * | 11/1999 | Swetish | 224/631 |
| 6,257,440 | B1 * | 7/2001 | Perkins et al. | 220/764 |
| 7,448,530 | B1 | 11/2008 | Winikoff | |
| 8,092,087 | B2 * | 1/2012 | Simhony et al. | 383/25 |
| 8,100,280 | B1 | 1/2012 | Hernandez | |
| 2009/0101254 | A1 * | 4/2009 | Vaccarella | 150/108 |
| 2009/0205759 | A1 * | 8/2009 | Vaccarella | 150/108 |
| 2011/0192877 | A1 * | 8/2011 | Murdoch et al. | 224/607 |

* cited by examiner

*Primary Examiner* — Shawn M Braden
(74) *Attorney, Agent, or Firm* — Brian M. Dingman; Dingman, McInnes + McLane, LLP

(57) ABSTRACT

A basket comprising a body and at least one strap, the body consisting of a bottom and an open top. The body includes ventilation holes which are also used as projection-receiving openings through which locking mechanisms may engage. At least one strap may be connected to the body in a variety of locations, based upon user preference and at least one strap may be adjustable for ease of use. The body also comprises guide slots through which the straps may be fed prior to their connection to the body. The body may also include handles which may be located in a variety of places near or within the top edge of the body. The basket may be used with or without straps, providing the user with versatility of use.

11 Claims, 8 Drawing Sheets

BASKET

CROSS-REFERENCE TO RELATED APPLICATION

This application claims benefit from U.S. Provisional Patent Application No. 61/834,187, filed Jun. 12, 2013, the contents of which are incorporated herein by reference.

BACKGROUND

This disclosure relates to baskets used to transport items such as laundry and other personal articles. This transportation can be laborious and, depending on the terrain, a potentially dangerous task in terms of one's ability to see the immediate foreground. Also, baskets and hampers used to transport belongings can apply significant strain on the lower back and other body parts, depending on the load being carried by the user. Those who must transport laundry or other articles outside of the home often must carry the baskets for significant distances which can be very strenuous and harmful.

Presently there are many different types of baskets used to carry laundry and similar articles from one place to another. However, there is a need for baskets which will minimize the strain on the body while also enabling the user to see clearly in front of him or her. Such a device will greatly minimize the struggle and danger of transporting belongings such as laundry from one place to another.

SUMMARY

The device disclosed herein is a basket which allows for safer and more convenient transportation of laundry and other belongings, while also decreasing the bodily strain upon the user. Straps may be used to carry the basket over one's hand or arm, or it may be carried in the same manner as a backpack, with its straps configured such that it is pulled toward the user's back. The straps are highly adjustable on the basket to allow flexibility among users. Straps may also be removed completely if preferred by the user, providing unique versatility of use for the basket.

The disclosure features a basket with a body which may be of a variety of shapes, circular or multi-sided, with sidewalls and at least one strap that is constructed and arranged to be releasably coupled to at least one of the sidewalls, where each strap has at least one locking mechanism, each locking mechanism comprising a projection with an enlarged head and a more narrow neck. The sidewalls of the basket body have projection-receiving openings which provide ventilation and locations through which locking mechanisms may attach, the openings comprising a lower section that is larger than the enlarged head of a locking mechanism and a contiguous upper section that is smaller than the enlarged head of a locking mechanism and similar to the neck of a locking mechanism, to allow the locking mechanism to be reliably locked into an opening, so as to enable adjustment of the position of the strap on the body sidewalls.

The basket may further include at least one guide slot in the upper rim of the basket body, sized and shaped to allow a strap to pass through, thereby keeping the strap from moving laterally. Each strap may have at least one locking mechanism, at either or both ends of the strap. At least one strap may have at least one locking mechanism on either or both sides of the strap at one or both of its ends. Each strap may attach to the basket in a variety of locations, including on opposing sides or on the same side of the basket. The basket may be utilized without the use of a strap, being carried by handles in the upper portion of the body, at least two of which may be on opposing sides.

Embodiments may include one of the following features, or any combination thereof. The strap locking mechanisms may also consist of hooks or clasps or the strap itself may provide its own attachment to the body through the ventilating holes or through guide slots on the upper portion or top of the body, or other places of attachment on the body.

DESCRIPTION OF EXAMPLES

Figure 1:
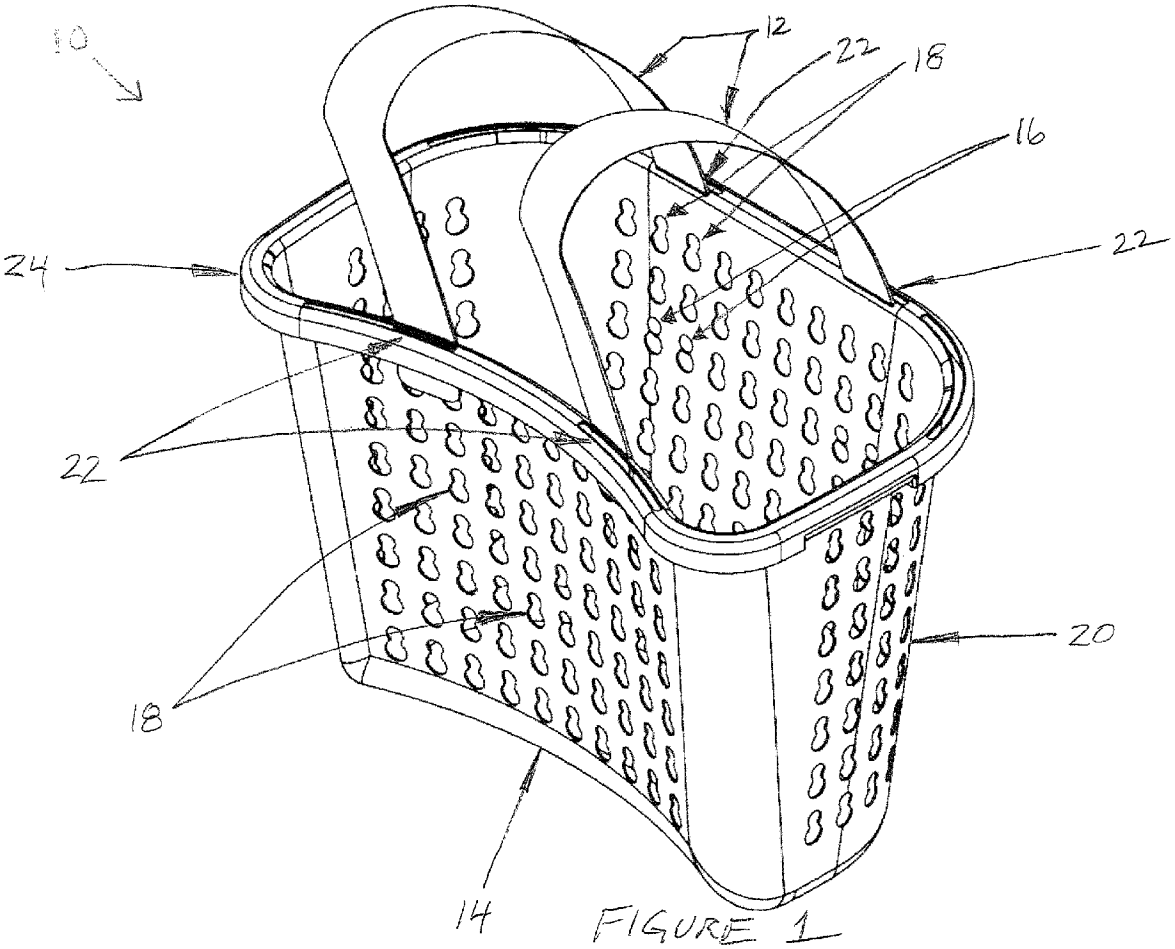
FIG. 1 is a perspective view of a basket with a body and straps.

FIG. 1 shows a basket 10 with an example of how straps 12 may be attached to a body 14. If a strap 12 is utilized with the body 14, its function may be optimized by inserting locking mechanisms 16 through a variety of projection-receiving openings 18 which may be located throughout the sidewalls 20 of the body 14, making the strap 12 position adjustable to user preference. In order to keep a strap 12 from moving laterally, it may go through a guide slot 22 near the top of the sidewalls 20 of the body 14 or within the curved top edge 24, as shown in the depicted embodiment. The ends of a strap 12 may be attached on each side of the body 14 to be carried over a hand/arm or over one's shoulder.

Figure 2:
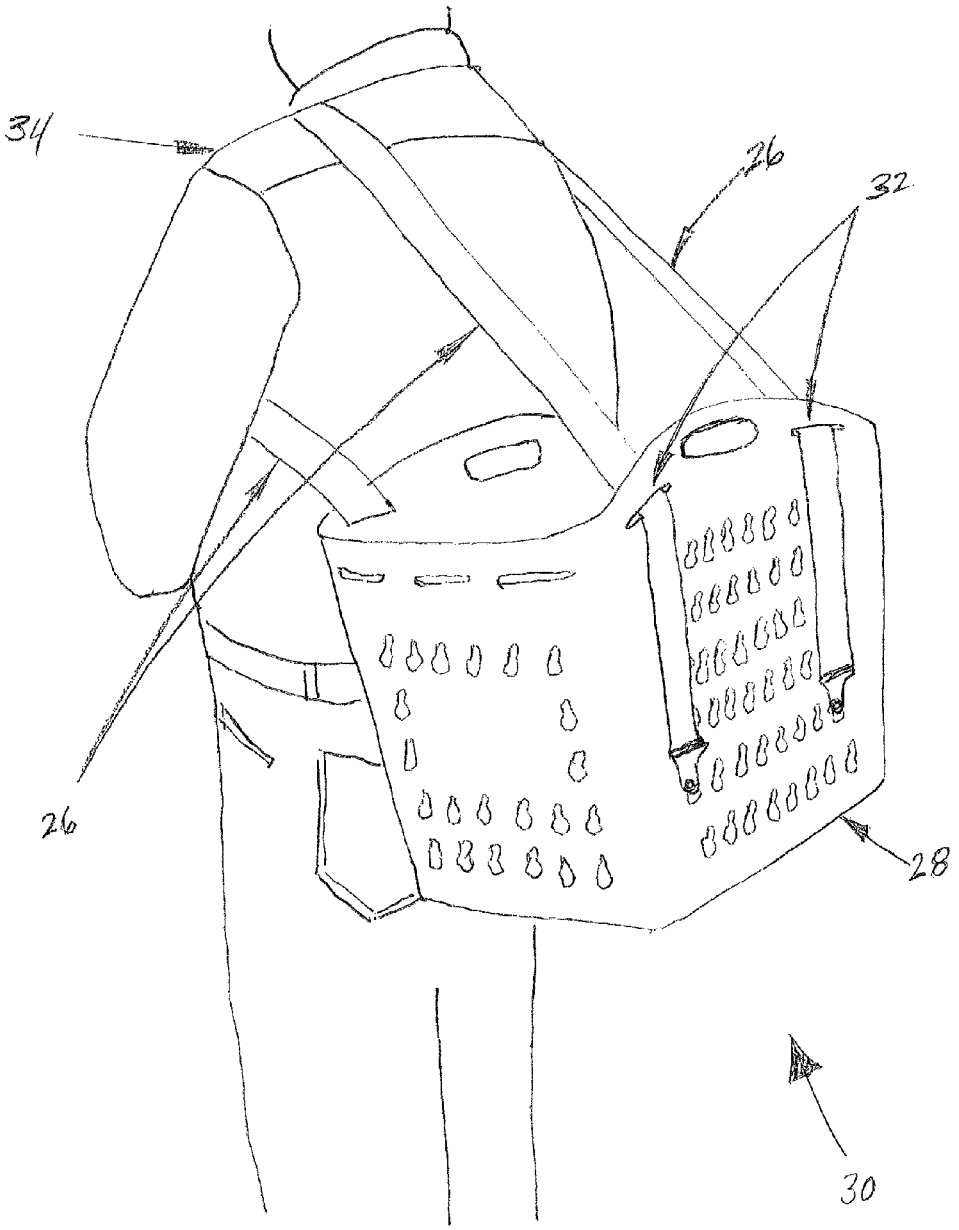
FIG. 2 shows an embodiment of a basket carried like a backpack, with basket straps feeding through slots near the top of the basket body and over the shoulders of a user.

FIG. 2 shows two straps 26 attached to a basket body 28 to be carried more like a backpack 30. This embodiment shows the straps 26 feeding through slots 32 near the top of the body 28 and wrapping around a user's shoulders 34. This configuration alters the distribution of stress upon the user's body, compared to when the basket body 28 is carried in front of the user. This configuration also allows for clear visibility of the user's immediate foreground. The body 28 may be fabricated with material which is flexible enough to be comfortable for the user when being pulled against one's body by the straps 26.

Figure 3:
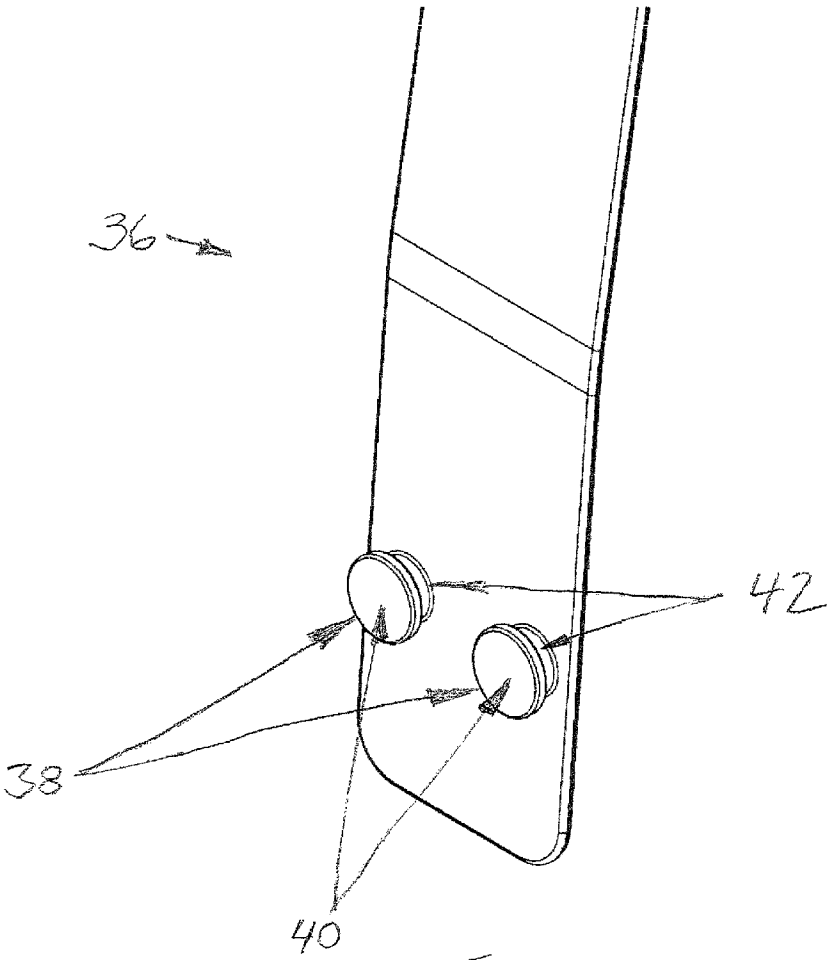
FIG. 3 is a detail view of a strap end with two locking mechanisms.

FIG. 3 shows the detail of a strap end 36 with two identical locking mechanisms 38. The faces 40 of the locking mechanisms 38 have a larger diameter than the necks 42 that are attached to the strap 36. The strap 36 may be fabricated from a variety of materials such as various plastics or woven materials.

Figures 4A, 4B:
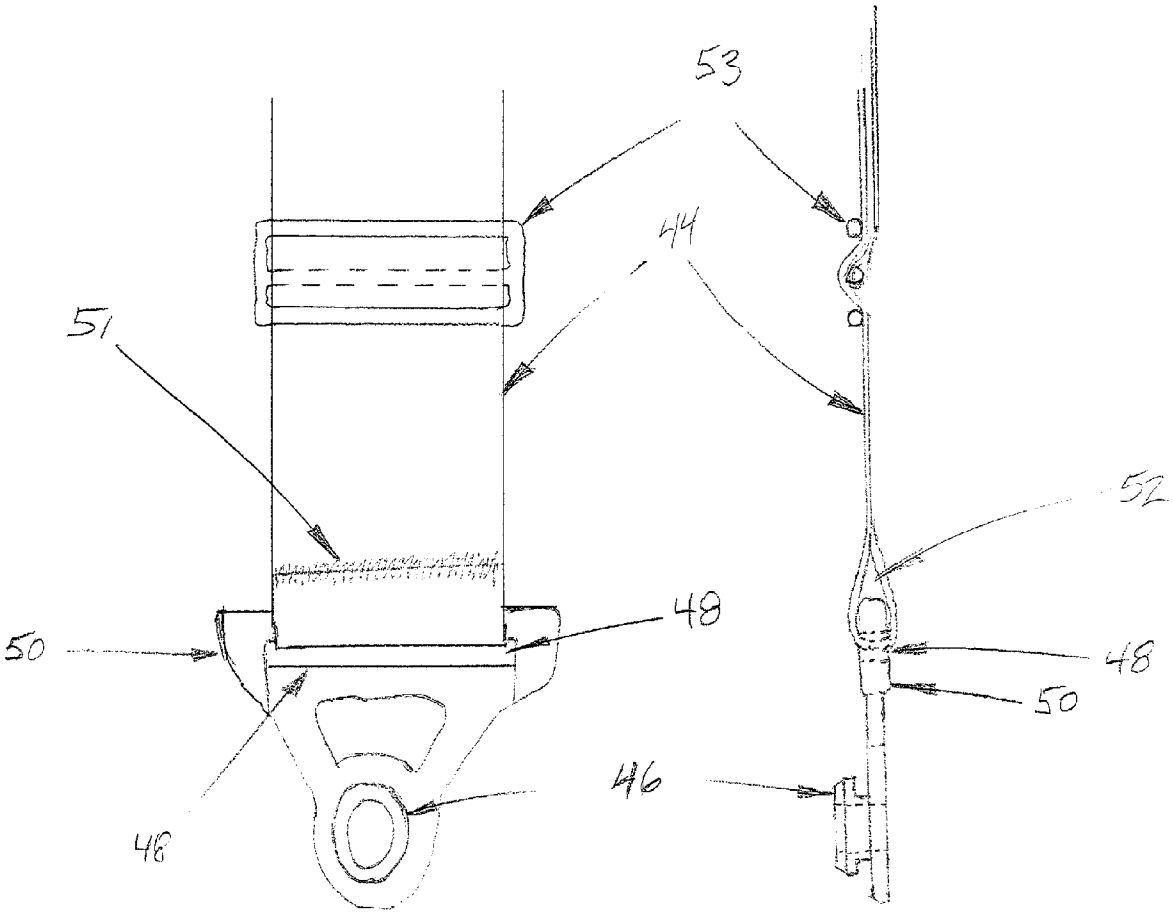
FIGS. 4A and 4B are detail front and side views, respectively, of a strap end with an alternate embodiment of a locking mechanism.

FIGS. 4A and 4B show front and side views, respectively, of an alternate embodiment of a strap 44 and a locking mechanism 46 on an end piece 50. This embodiment consists of a strap 44 feeding through a slot 48 within an end piece 50. The end of the strap 44 is fed through the slot 48 in the end piece 50 and then wrapped upon, and then sewn or formed to itself 51, creating a loop 52 which secures the end piece 50, with its locking mechanism 46, to the strap 44. The strap 44 may also be adjusted in length through a clasp 53 which can be moved upon the length of the strap 44 so that it may secure upon itself, as is commonly used with over-the-shoulder straps for briefcases and/or duffle bags, thereby altering the strap's 44 overall length.

Figure 5:
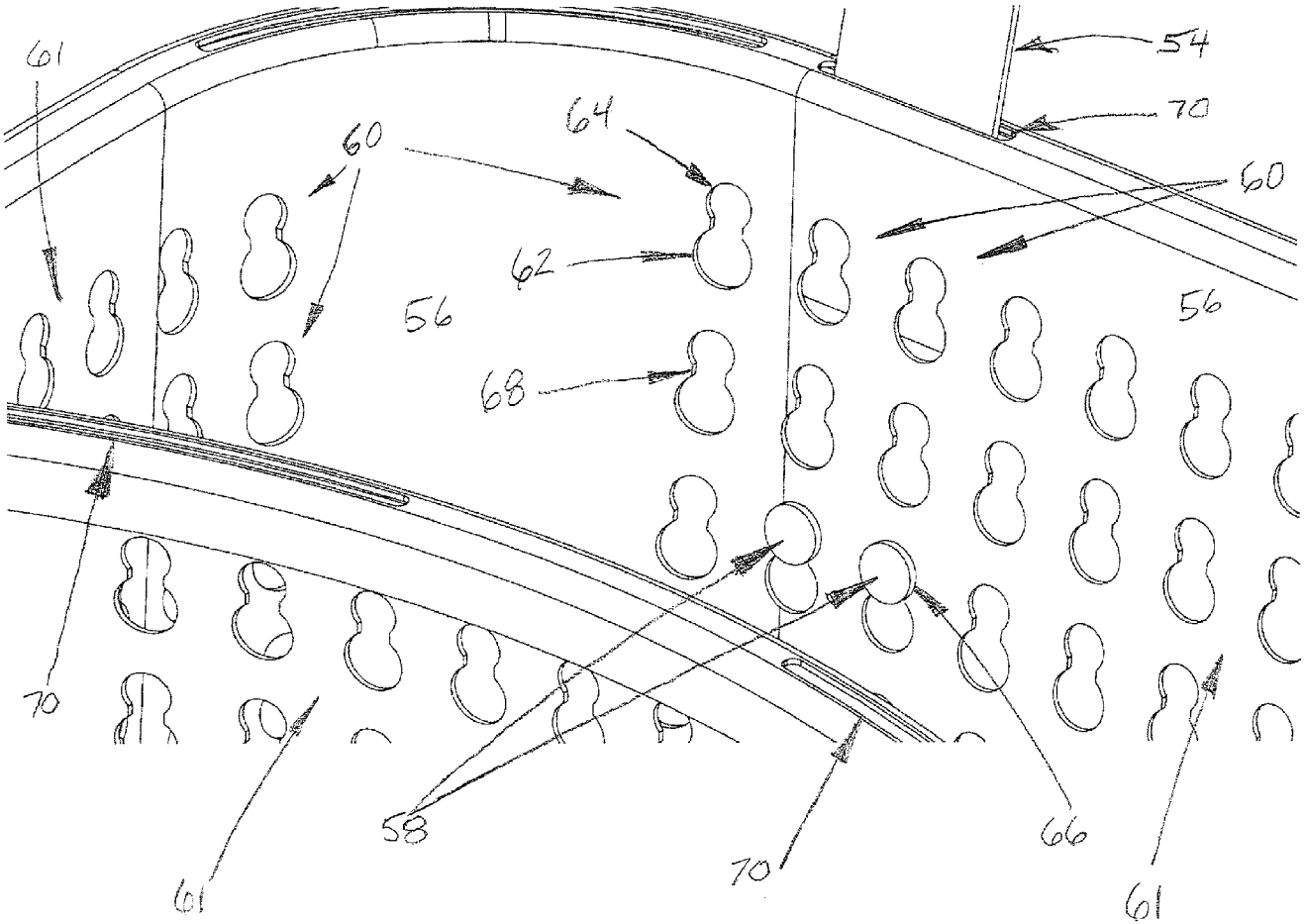
FIG. 5 is a detail view a basket's strap connected to a basket body.

FIG. 5 shows a detailed view of an interlocking connection between a strap 54 and a body 56. A locking mechanism 58 near the end of a strap 54 may insert within user-selected projection-receiving openings 60 providing a variety of lengths and a method of locking the strap 54 in place. Most of a body's sidewalls 61 may be populated with projection-receiving openings 60 for ventilation and connection to a strap 54, as can be seen on the figure. A locking mechanism 58 is inserted in the lower half 62 of the projection-receiving openings 60 in the body 56. A projection-receiving opening 60 exhibits a contiguous merging of a larger diameter hole 62 and a smaller diameter hole 64. The larger diameter hole 62 is below the smaller diameter hole 64. A locking mechanism 58 may be inserted within the larger diameter hole 62 as it is larger than the head 66 of a locking mechanism 58. After a locking mechanism 58 is inserted in the larger diameter hole 62, the strap 54 may be pulled upward in order to move the locking mechanism 58 so that it is in contact with the upper, smaller diameter hole 64 in the body sidewall 61. An area 68 between the large diameter hole 62 and the small diameter hole 64 is fabricated such that its opening does not allow a locking mechanism 58 to move down from a top smaller diameter hole 64 unless pulled down by the user, ensuring its placement and eliminating concern that a locking mechanism 58 may move out of position. A strap 54 may be kept from moving laterally by feeding it through a guide slot 70 which may be located on or near the top of the body 56.

Figure 6:
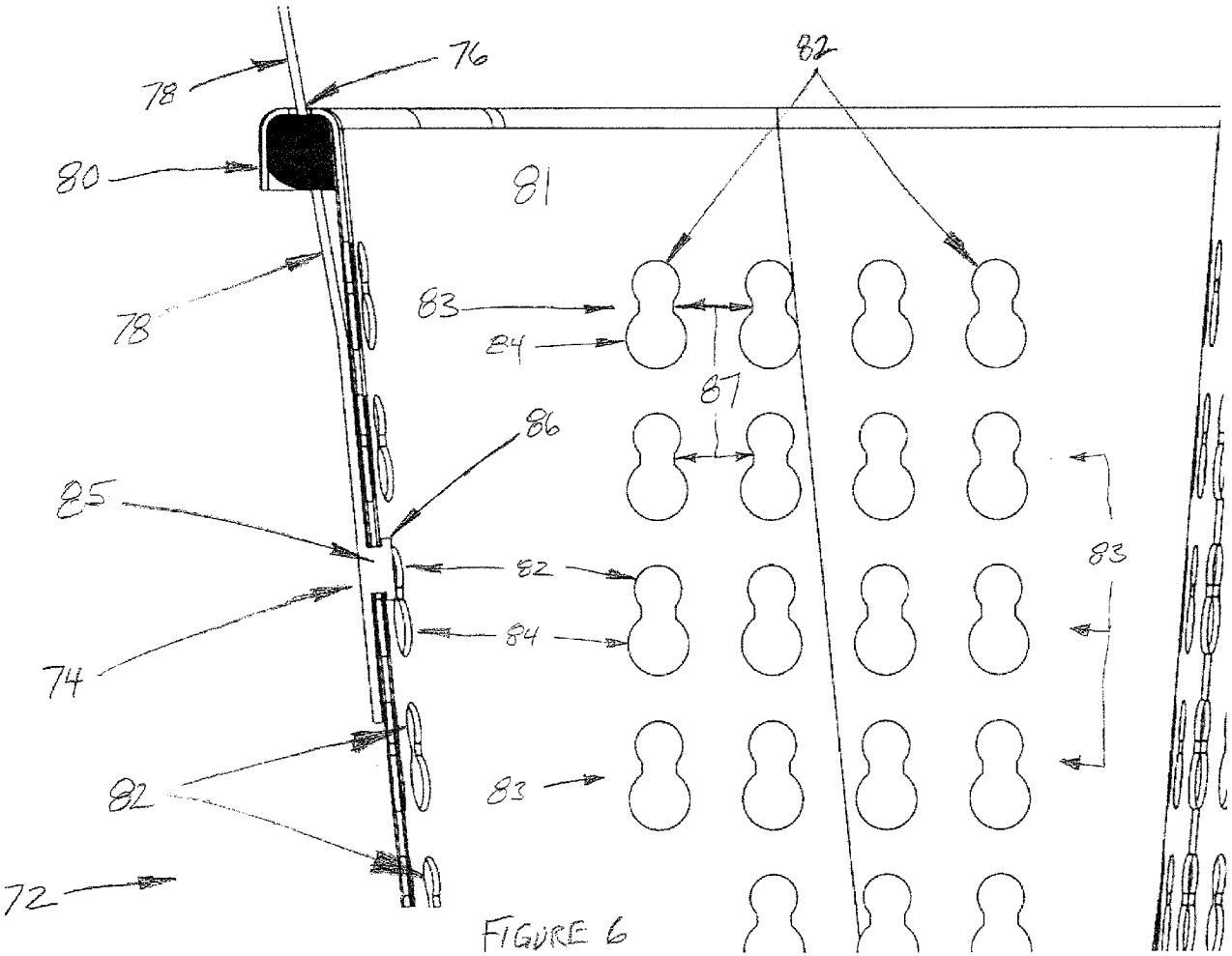
FIG. 6 is a cross-section view of basket's body and strap.

FIG. 6 shows a detailed cross-section of one embodiment of a basket 72 with attention to a user-selected position of a locking mechanism 74. A guide slot 76 for a strap 78 can be seen on top of a curved edge 80 of a basket body 81 as depicted in this embodiment. The locking mechanism 74 is shown in its locked position, having been pulled upward into a top, smaller diameter hole 82 above a larger diameter hole 84. The cross-section of the locking mechanism 74 reveals the size of its neck 85 versus its face 86, allowing it to be secured within a smaller diameter hole 82 of a user-selected projection-receiving opening 83, the smaller hole 82 having a diameter roughly the same as a neck 85 of a locking mechanism 74, and slightly larger than the lateral distance across the area 87 between a larger diameter hole 84 and a smaller diameter hole 82.

Figure 7:
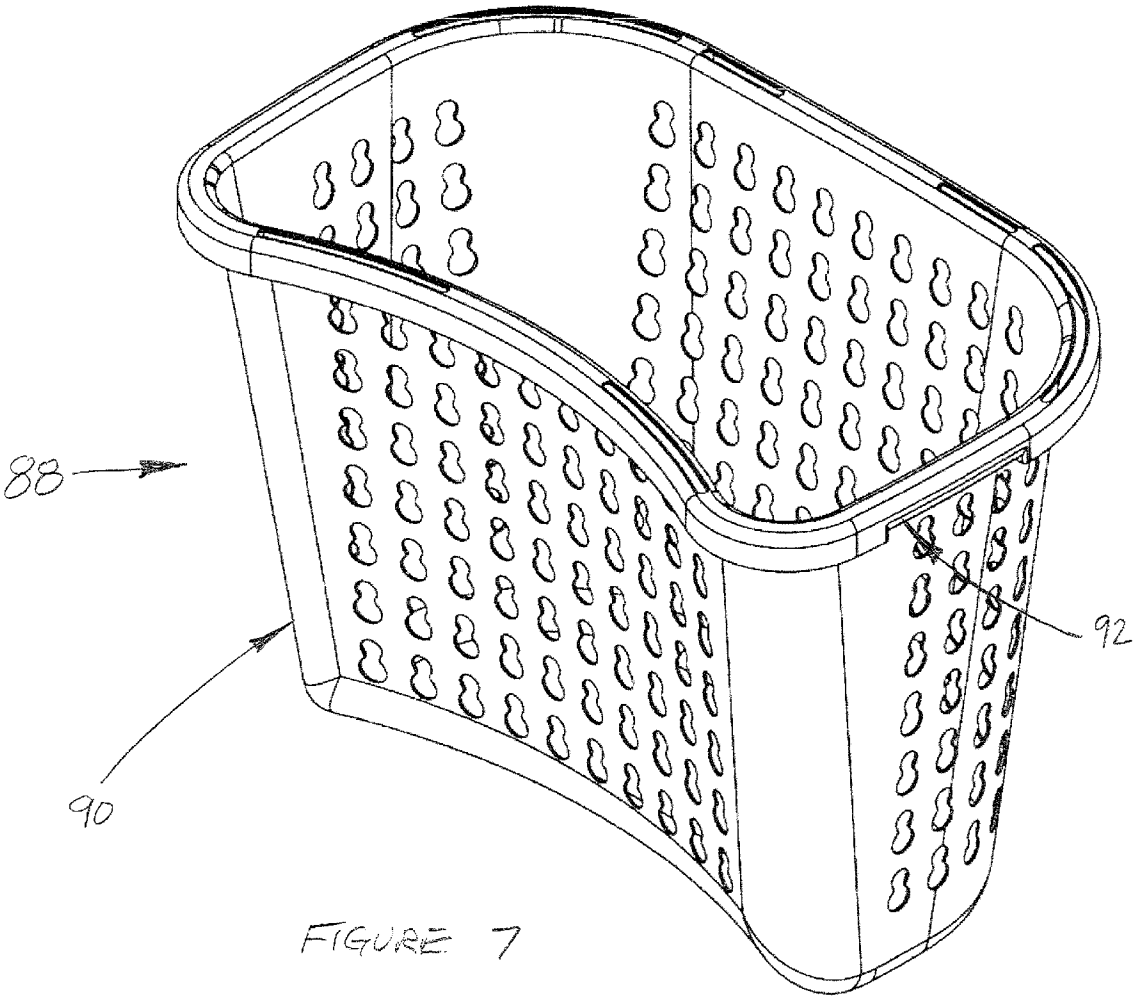
FIG. 7 is a perspective view of a basket's body.

FIG. 7 shows an embodiment of a basket 88 with only its body 90, providing versatility of use. The body 90 may have one or more molded-in handles 92 for carrying if desired by the user.

Figure 8:
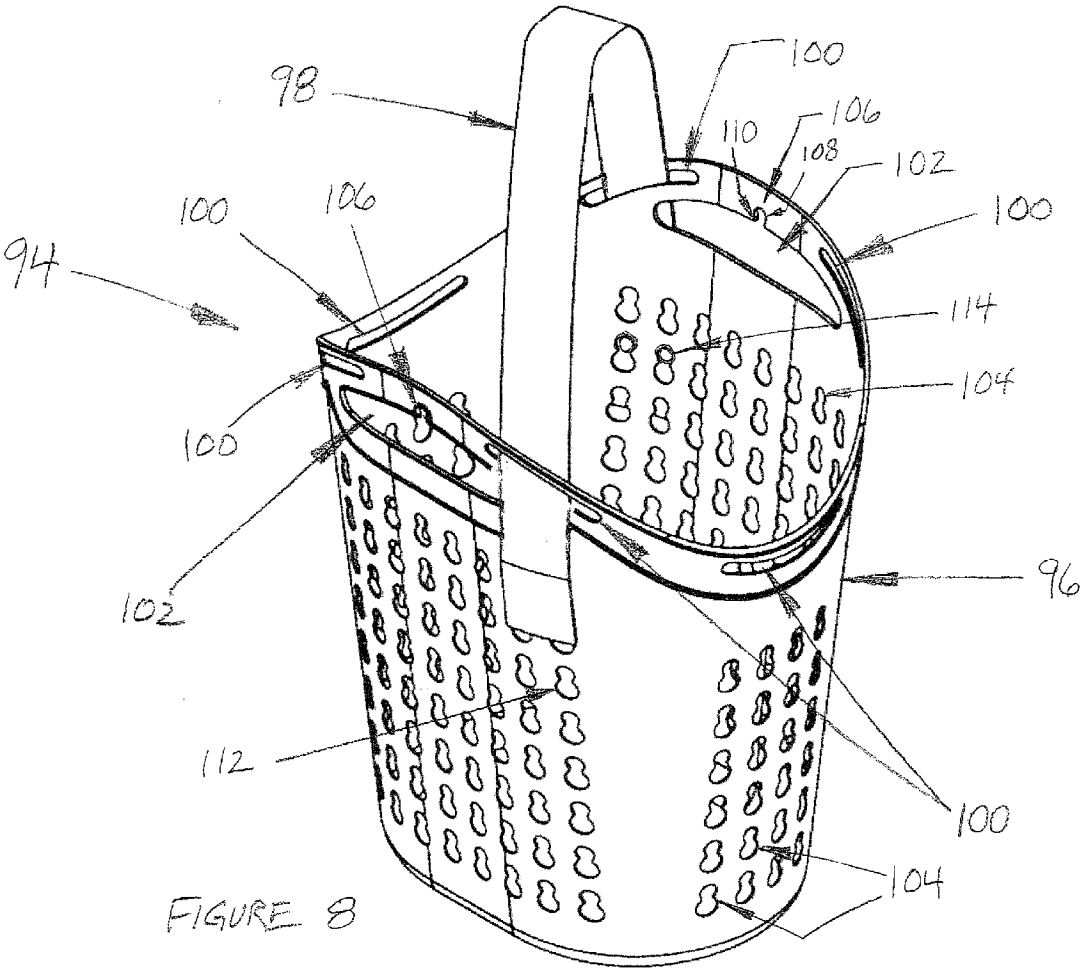
FIG. 8 is a perspective view of an alternate embodiment of a basket.

FIG. 8 shows an alternative basket 94 embodiment of a body 96 with a movable locking strap 98 in use. This alternative basket 94 exhibits guide slots 100 similar to those featured in the previous embodiments. Two handles 102 are utilized along with a multitude of connecting projection-receiving openings 104 throughout much of the body 96 surface for a variety of connection points for the user. Attachment locations 106 can be seen at the top portion of the handles 102. The attachment locations 106 function in the same manner as a projection-receiving opening 104 in the body 96. An attachment location 106 comprises a smaller diameter hole 108 above, and connected to, an area 110 which is above, and connected to, the handle 102. The handle 102 functions in the same manner as a larger diameter hole 112 in the upper portion of the projection-receiving openings 104, allowing a locking mechanism 114 to be inserted into the handle opening 102. The locking mechanism 114 may then be pulled upward into an attachment location 106 which secures the locking mechanism 114 into a smaller diameter hole 108 of the attachment location 106.

All embodiments of the disclosure may be fabricated in part or wholly with a variety of materials and colors. This, along with a number of implementations, has been described. Nevertheless, it will be understood that additional modifications may be made without departing from the scope of the inventive concepts described herein, and, accordingly, other embodiments are within the scope of the following claims.

What is claimed is:

1. A basket, comprising:

a continuous body comprising a plurality of sidewalls, an upper rim, a bottom and an open top, the bottom and top having areas;

a strap with two opposing sides and two ends, the strap constructed and arranged to be releasably coupled to at least one sidewall, where the strap has at least one locking mechanism on each end, each locking mechanism comprising a projection with an enlarged head and a more narrow neck;

where the sidewalls have a plurality of projection-receiving openings, each of the openings comprising a lower section that is larger than the enlarged head of a locking mechanism and a contiguous upper section that is smaller than the enlarged head of a locking mechanism and roughly the same as the neck of a locking mechanism, where the locking mechanism can be releasably engaged with openings so as to be able to adjust the position of a strap and maintain its position; and handles on or near the upper rim of the body that are constructed and arranged to releasably engage with a strap end and, at least one projection-receiving opening at the top of the handle.

2. The basket of claim 1 wherein an area between the upper and lower sections of the projection-receiving openings is slightly narrower than the neck of the locking mechanism in order to inhibit the locking mechanism from moving downward, allowing the locking mechanism to be reliably locked into the upper part of an opening.

3. The basket of claim 1 wherein the area of the bottom of the body is smaller than the area of the open top.

4. The basket of claim 1 wherein the shapes of the bottom and top of the body are circular.

5. The basket of claim 1 wherein the shapes of the bottom and top of the body are elliptical.

6. The basket of claim 1 further comprising at least one guide slot in the upper rim, each guide slot sized and shaped to allow a strap to pass through.

7. The basket of claim 1 further comprising one or more guide slots located near the top of the body, the guide slot sized and shaped to allow a strap to pass through.

8. The basket of claim 1 wherein the strap has at least one locking mechanism on one or both sides of the strap at one or both of its ends.

9. The basket of claim 1 further comprising a clasp attached to an end of the strap, the clasp constructed and arranged to allow the strap to be fed through it, providing variation in overall length of the strap to be adjusted by the user.

10. The basket of claim 1 wherein the strap attaches to the body without the use of additional hardware attachment devices.

11. A basket, comprising:

a continuous body comprising a plurality of sidewalls, a bottom and an open top;

two straps, each with two opposing sides and two ends, the straps constructed and arranged to be releasably coupled to at least one sidewall, where the straps have one locking mechanism on each end, each locking mechanism comprising a projection with an enlarged head and a more narrow neck;

where the sidewalls have a plurality of projection-receiving openings, each of the openings comprising a lower section that is larger than the enlarged head of a locking mechanism and a contiguous upper section that is smaller than the enlarged head of a locking mechanism and roughly the same as the neck of a locking mechanism, where the locking mechanism can be releasably engaged with projection-receiving openings so as to be able to adjust the position of the straps and maintain their position;

an area between the upper and lower sections of the projection-receiving openings which is slightly narrower than the neck of the locking mechanism in order to inhibit the locking mechanism from moving downward, allowing the locking mechanism to be reliably locked into the upper part of an opening;

a plurality of guide slots located near the top of the body, the guide slots sized and shaped to allow a strap to pass through each of them; and handles on or near the upper rim of the body that are constructed and arranged to releasably engage with a strap end and, at least one projection-receiving opening at the top of the handle.

* * * * *